US010759567B2

(12) United States Patent
Zum-Dohme et al.

(10) Patent No.: US 10,759,567 B2
(45) Date of Patent: Sep. 1, 2020

(54) FLEXIBLE PACKAGING CONTAINER

(71) Applicant: Bischof + Klein SE & Co. KG, Lengerich (DE)

(72) Inventors: Rolf Zum-Dohme, Lengerich (DE); Christoph Reinker, Emsdetten (DE)

(73) Assignee: Bischof + Klein SE & Co. KG (DE)

( * ) Notice: Subject to any disclaimer, the term of this patent is extended or adjusted under 35 U.S.C. 154(b) by 0 days.

(21) Appl. No.: 15/510,276

(22) PCT Filed: Sep. 14, 2015

(86) PCT No.: PCT/EP2015/001834
§ 371 (c)(1),
(2) Date: Mar. 10, 2017

(87) PCT Pub. No.: WO2016/041629
PCT Pub. Date: Mar. 24, 2016

(65) Prior Publication Data

US 2017/0253382 A1 Sep. 7, 2017

(30) Foreign Application Priority Data

Sep. 15, 2014 (DE) ..... 20 2014 007 340 U

(51) Int. Cl.
*B65D 33/01* (2006.01)
*B65D 30/08* (2006.01)
(Continued)

(52) U.S. Cl.
CPC ..... *B65D 31/04* (2013.01); *B65D 31/08* (2013.01); *B65D 33/01* (2013.01); *B65D 33/02* (2013.01); *B65D 31/145* (2013.01); *B65D 39/14* (2013.01)

(58) Field of Classification Search
CPC ..... B65D 31/04; B65D 31/08; B65D 31/145; B65D 33/02; B65D 33/01; B65D 39/14
(Continued)

(56) References Cited

U.S. PATENT DOCUMENTS 4,874,620 A * 10/1989 Mendenhall ..... B65D 33/01 383/101
5,655,842 A * 8/1997 Hagino ..... B32B 37/1292 220/366.1
(Continued)

FOREIGN PATENT DOCUMENTS

DE 202005021161 U1 5/2007
DE 202011106386 U1 1/2012
(Continued)

*Primary Examiner* — Jes F Pascua
(74) *Attorney, Agent, or Firm* — Husch Blackwell LLP

(57) ABSTRACT

Disclosed is a flexible packaging container, in particular a plastic film pouch or bag for bulk goods, comprising a front wall (2) and a rear wall (3) as well as a holding space (15) between said walls (2, 3) for goods to be stored; the walls (2, 3) are made at least in part of a film material; the flexible packaging container further comprising an intermediate space (14) which is formed by an inner ply (4) and is separated from the holding space (15) by said inner ply (4); the holding space (15) can be evacuated into the intermediate space (14) via at least one holding space evacuation hole (7) in the inner ply (4), and the intermediate space (14) can be evacuated out of the packaging container (1) via at least one additional evacuation hole (11) that interrupts a transverse seam; the front wall (2) does not comprise any of the longitudinal seam (12) that seals the packaging container (1) in the peripheral direction; the inner ply (4) is formed by a strip (4) which is located on a side of the front wall (2) facing the intermediate space (14) and which is fastened to the front wall (2) using two longitudinal seams extending between top and bottom transverse seams (5.1, 5.2).

15 Claims, 5 Drawing Sheets

(51) Int. Cl.

| | |
|---|---|
| ***B65D 30/18*** | (2006.01) |
| ***B65D 33/02*** | (2006.01) |
| *B65D 30/24* | (2006.01) |
| *B65D 39/14* | (2006.01) |

(58) Field of Classification Search
USPC ..... 383/100–103
See application file for complete search history.

(56) References Cited

U.S. PATENT DOCUMENTS

| | | | | |
|---|---|---|---|---|
| 5,839,832 | A * | 11/1998 | Hagino | B32B 37/1292 383/101 |
| 6,582,123 | B1 * | 6/2003 | Tang | B65D 33/01 383/100 |
| 7,927,015 | B2 * | 4/2011 | Heinemeier | B65D 33/01 383/101 |
| 8,371,752 | B2 * | 2/2013 | Heinemeier | B65D 33/01 383/101 |
| 2005/0281493 | A1 * | 12/2005 | Heinemeier | B65D 33/01 383/103 |
| 2009/0123094 | A1 * | 5/2009 | Kreymborg | B65D 33/01 383/103 |
| 2011/0188786 | A1 * | 8/2011 | Heinemeier | B65D 33/01 383/101 |
| 2012/0261278 | A1 * | 10/2012 | Mandzsu | B65B 1/22 206/213.1 |
| 2014/0029873 | A1 * | 1/2014 | Cruz | B65B 9/20 383/45 |

FOREIGN PATENT DOCUMENTS

| | | | | |
|---|---|---|---|---|
| DE | 202012006946 | U1 | 10/2012 | |
| DE | 10 2013 000 038 | | 7/2014 | |
| EP | 0144011 | A2 * | 6/1985 | B65D 33/01 |
| EP | 1 607 339 | | 12/2005 | |
| EP | 2168885 | A1 * | 3/2010 | B65D 33/01 |
| EP | 2955126 | A2 * | 12/2015 | B65D 33/01 |
| JP | 08091451 | A * | 4/1996 | B65D 33/01 |
| JP | H11 79198 | | 3/1999 | |
| WO | 2007115538 | A1 | 10/2007 | |

* cited by examiner

FLEXIBLE PACKAGING CONTAINER

BACKGROUND OF THE INVENTION

The present invention concerns a flexible packaging container, in particular a plastic film pouch or bag for bulk goods, comprising a front wall and a rear wall and a holding space formed between these walls for goods to be stored, wherein the walls at least partially are made of a film material, comprising an intermediate space formed by an inner ply and separated by the inner ply from the holding space, and wherein by means of a receiving space venting device arranged in the inner ply venting of the holding space into the intermediate space and by means of at least one further venting opening interrupting a transverse seam venting from the intermediate space out of the packaging container can be realized.

Prior art of this kind is disclosed in EP 1 607 393 B1. Usually, and thus also in the cited prior art, the longitudinal seams of bags are produced on the pouch back. Usually, on this side also the venting channel is provided in the area of overlapping edges of the container which is often produced from a flat film. When the bag with the venting opening in a longitudinal or transverse seam after filling is placed on the back, the intermediate space is compressed due to the material contained in the packaging container. Thus, venting cannot occur at all or only with difficulty. It is therefore conventional to first place the bags on the front side for venting purposes after filling, to then compress them to a flat state in order to vent them, and to subsequently turn them over in a turning station in order to then place them on pallets with the front side facing up. This entails expenditures with regard to time and machine technology.

Moreover, the overlap area is limited in regard to the width for reasons of material quantity and thus also costs, the same material must be used that is also used for the remainder of the wall.

It is object of the present invention to provide a packaging container which is better suited for a venting action and can be embodied less expensive with regard to manufacture.

SUMMARY OF THE INVENTION

The object is solved for a packaging container of the aforementioned kind in that the inner ply is formed by a strip that is arranged on a side of the front wall oriented toward the intermediate space and, by means of two longitudinal seams extending between top and bottom transverse seams, is attached to the front wall. Advantageous embodiments of the invention can be taken from the dependent claims as well as from the following description.

According to the invention, it is provided that the inner ply is formed by a strip which is arranged on a side of the front wall facing the intermediate space and which, by means of two longitudinal seams extending between the top and the bottom transverse seams, is attached to the front wall, thus in particular to its inner side.

The configuration according to the invention has the advantage that the turning station used in the prior art can be eliminated because the bag lying on its back can vent, even when it is resting on the back, due to the intermediate layer arranged to face the front wall.

The intermediate layer can be a strip which is supplied in longitudinal direction or in transverse direction that on four sides is fastened to an inner side of the front wall. In this context, a front layer or wall is understood to be the film section which for a filled bag in a plan view onto the lying bag is facing to the front. This side is usually printed on for information and or advertising purposes. The inner ply can either form only partially with the front layer a multi-layer front wall but it can also be arranged across the entire surface on the inwardly oriented side of the front layer. In the context of material savings, it is advantageous when, in case of a strip supplied in longitudinal direction, the latter is provided with a reduced width on the inner side of the front wall. The same holds true for a strip which is transversely inserted in the production process and which, viewed in longitudinal direction of the manufacturing process, has a reduced height compared to the packaging container.

By means of a separately supplied strip that is arranged on the inner side, the adaptation of the venting performance can moreover be improved relative to the prior art, where the manufacture of an overlapping area produced from the lateral areas of a flat film with regard to manufacturing technology is limited to a position that is more or less arranged at the middle of the rear wall. The material of the strip and positioning on the front wall can be selected freely, with restrictions in regard to the sealing capability.

The venting opening can be produced by means of a passage interrupting the transverse seam. The passage is advantageously produced for a uniform production process by supplying a no-seal strip that prevents a closed connection between the front wall and the inner ply during sealing and production of the transverse or longitudinal seams. The no-seal strip forms for this purpose no connection to the adjoining film material on one side during sealing, fuses however preferably on its opposite side with the contacting layer/wall in order to be fastened thereto and to not slide out of the packaging container. Accordingly, it is also advantageous to continuously supply a sealing strip that is supplied in longitudinal direction and thereby produce a passage in the transverse seam at the bottom side as well as the topside so that venting of the intermediate space is improved.

The inner ply which may also be referred to as intermediate layer must not be produced of the same film material as the front and/or the rear layer. However, for reasons of manufacturing technology, it can be a film part provided with at least one venting opening that has been separated in the manufacturing process from a film that forms the front and/or rear wall. Venting openings can be, for example, already present in the material due to the manufacturing process, they can be produced e.g. also by punching or needling.

Preferably, the invention concerns a packaging container which is manufactured from a flat film which is folded together at the rear and whose sides are connected to each other by a longitudinal seam.

By means of the preferably separate supply of a strip, the latter can be, for example, a thinner, less expensive material which is already provided with holes for the purpose of forming holding space venting openings, wherein also non-woven and/or filmstrip combinations of different materials are suitable. In any case, the inner ply is adaptable to the goods to be stored with regard to number and type of the holding space venting openings. Since the venting openings that take care of venting from the intermediate space and thus from the packaging container are preferably formed as passages present in the terminal transverse seams, the generally thicker film forming the front or rear wall must not be damaged. The front layer is therefore available across the entire surface area for an appropriate printing pattern which can be printed on directly after production of the bag which can also be offered as FFS bag (form, fill, and seal). In the latter case, the transverse seams are produced not until filling of the packaging container.

For a continuous non-intermittent supply, the strip, which is produced in particular also of film and which is also in particular thinner than the front layer, extends preferably across the entire length of the front wall (supply in longitudinal direction). It extends then into the transverse seams which are delimiting the packaging container and is secured by these top and bottom transverse seams. Therefore, it can be used across the entire height for formation of venting openings. Accordingly, a no-seal strip can also extend from the top to the bottom transverse seam.

By use of a no-seal strip or the introduction of an area which is not adhesive or not sealable into the transverse seam, the venting opening is formed independent of overpressure and is thus in particular continuously present. Therefore, in particular for finely divided bulk goods that require venting already for a minimal filling level, venting can be realized already at lowest differential pressures between holding space and environment.

In the longitudinal direction of the strip, i.e., preferably in production and supply direction of the packaging container or of the strip, the venting opening and the holding space venting opening (in a projection onto the front layer) are spaced apart from each other. Accordingly, venting openings, for example, in a needled area, can be present across the entire length of the strip which enables good venting across the height of the packaging container. The adaptation of the venting performance to the fill goods and the herewith associated transport air quantity is easily possible. Accordingly, for the same number and size of holding space venting openings, the strip can be made smaller. Accordingly, the packaging container according to the invention is well suited for a manufacture without repeating pattern.

For variants according to the invention with repeating pattern, in which, viewed transverse to the strip (and in projection onto the front wall), the venting opening and the holding space venting opening are spaced apart from each other, this applies likewise, with restrictions. For such variants, in which the venting openings are arranged in the transverse seam and the holding space venting openings are present rather at the middle of the height of the inner ply, the strip must be designed wider for identical venting performance.

The venting performance can be further advantageously affected when at least one spacer is present which is formed partially of a film material and which spaces apart the inner ply from the front wall. In this way, intermediate spaces are kept free in the intermediate space and it is prevented that the inner ply and the front layer are resting on each other and thereby prevent venting.

In particular, it is advantageous when the packaging container comprises at least one deflection element which prevents a direct straight connection for venting between holding space venting opening and venting opening. This also enables control of the venting performance and adjustment to the bulk goods. In case of holding space venting openings which are formed across the entire length of the supplied strip, such a deflection element begins advantageously already with the transverse seam in order to avoid an immediate venting of an area which is directly connected with the holding space venting openings at the level of the passage. Venting can thus be controlled better.

For a precisely defined intermediate space, it is moreover advantageous when the inner ply is attached by at least one fixation between the longitudinal seams to the front wall. This applies in particular to a combination of spacers, fixations, and deflection elements, wherein deflection elements can be formed in particular by fixations or spacers.

Instead of a single venting opening in the area of the transverse seam, viewed in the longitudinal direction of the supplied strip, the packaging container can have two or more adjacently positioned passages in the transverse seam in order to increase the venting performance. Viewed in the same direction, they can, for example, delimit on both sides an area of the strip provided with venting openings.

BRIEF DESCRIPTION OF THE DRAWINGS

Further advantages and details of the invention can be taken from the following figure description. Schematically illustrated, it is shown in.

DESCRIPTION OF PREFERRED EMBODIMENTS

Figure 1:
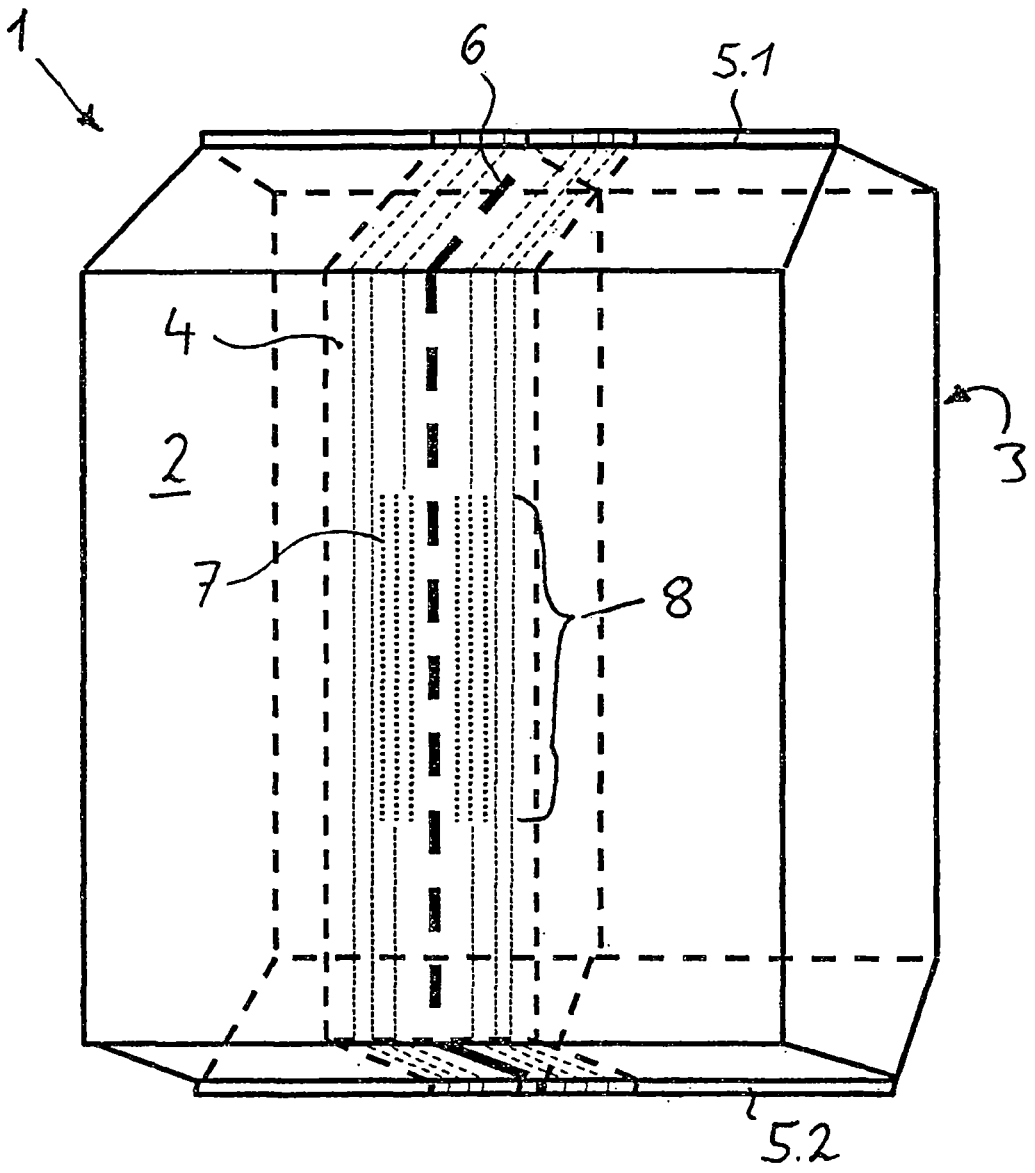
FIG. 1 a first embodiment of the invention in perspective view.

Individual technical features of the embodiments described in the following can also be combined in combination with afore described embodiments as well as the features of the independent claim and possible further claims to objects according to the invention. Provided that it is meaningful, functionally identically acting elements are provided with identical reference characters.

Figure 2:
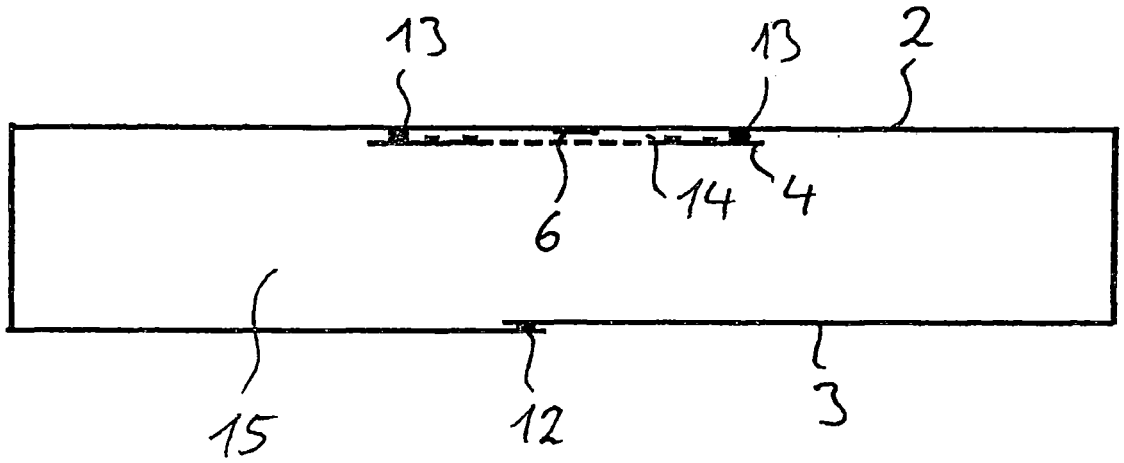
FIG. 2 the object of FIG. 1 in a cross section approximately at the level of the middle of the object according to FIG. 1.
Figure 3:
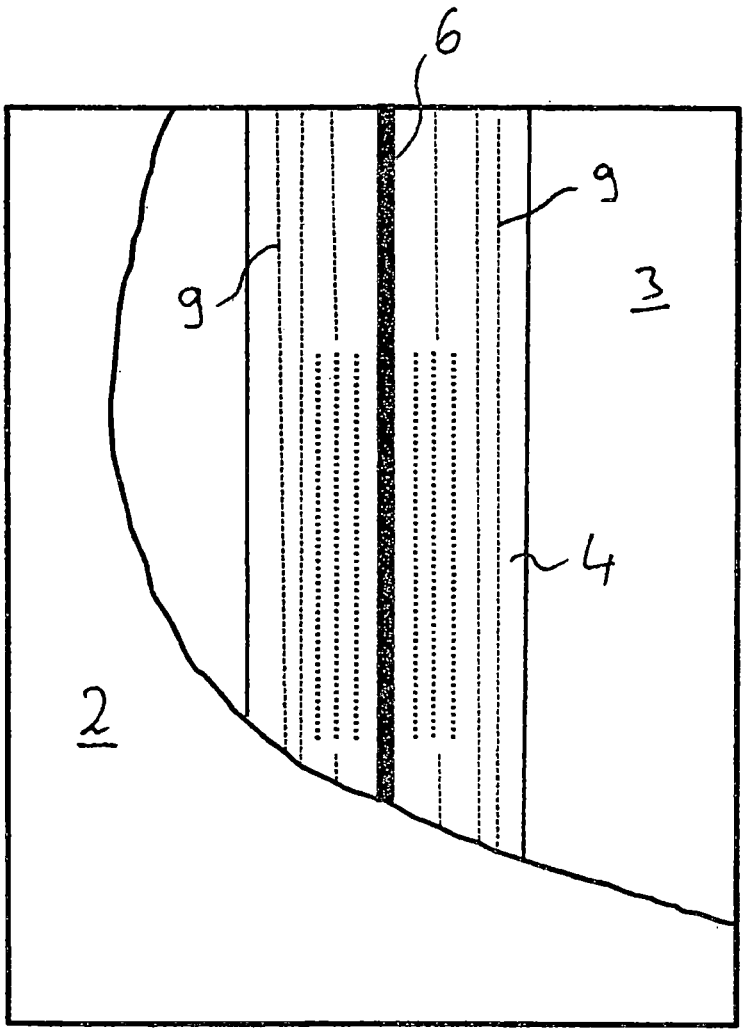
FIG. 3 a partially broken away front view of the object according to FIG. 1.

A flexible packaging container 1 according to FIG. 1 comprises a front wall 2, a rear wall 3 (compare FIG. 2) and an aforesaid inner layer, illustrated in dashed lines, that is embodied as a separate (film) strip 4 which has been supplied in longitudinal direction during the manufacture of the packaging container. At the top and bottom ends, the packaging container is closed by sealed transverse seams 5.1 and 5.2. A no-seal strip 6 (illustrated in FIG. 1 in dashed lines) extends from the top transverse seam 5.1 to the transverse seam 5.2 and is on one side attached to the front layer or to the inner or intermediate ply formed by the film strip 4. Holding space venting openings 7 are spaced apart in an area 8, viewed in transverse direction, from venting openings which are formed by passages in the transverse seam 5.1 or the transverse seam 5.2.

This concerns a repeating pattern-oriented variant of a packaging container 1 in which, by means of a repeating pattern control, an exact positioning of the strip 4 between the transverse seams 5.1 and 5.2 is effected. Embossing lines 9 which can be generated by embossing of the inner ply, form spacers in the intermediate space so that the inner ply 4 and the front wall 2 or the front layer are held at a spacing from each other.

Figure 4:
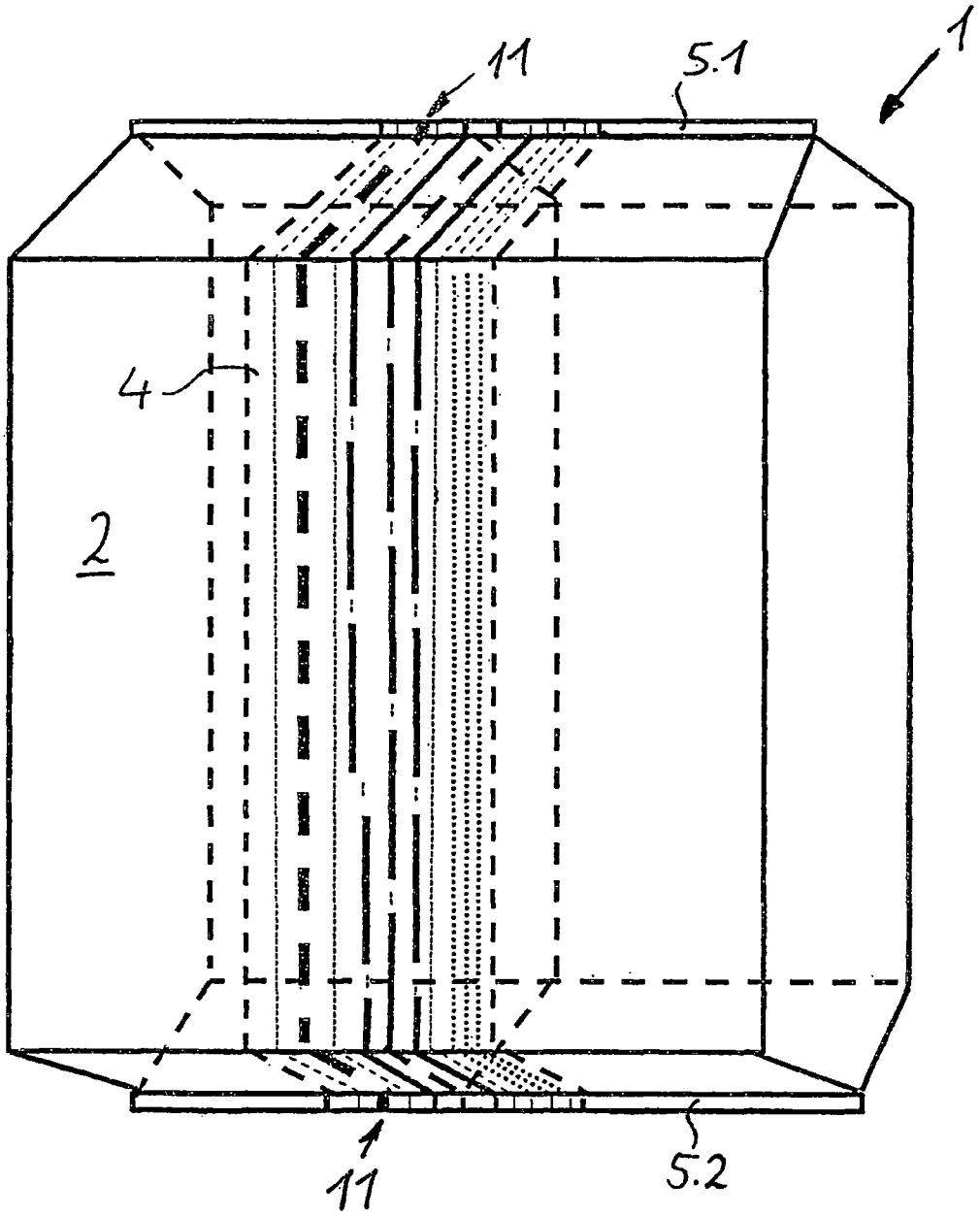
FIG. 4 a further embodiment of the invention in perspective view.

In the embodiment according to FIG. 4 et seq., a strip 4 which is embodied as a film strip is introduced without repeating pattern orientation into a packaging container 1.

Figure 5:
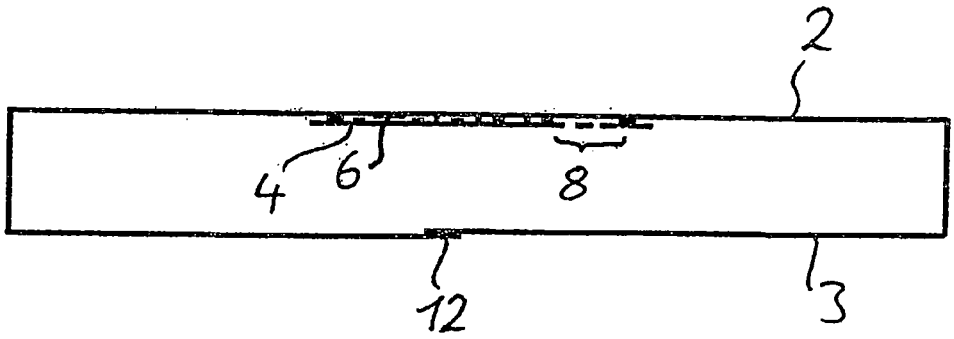
FIG. 5 the object of FIG. 4 in a cross section at the middle of the height.
Figure 6:
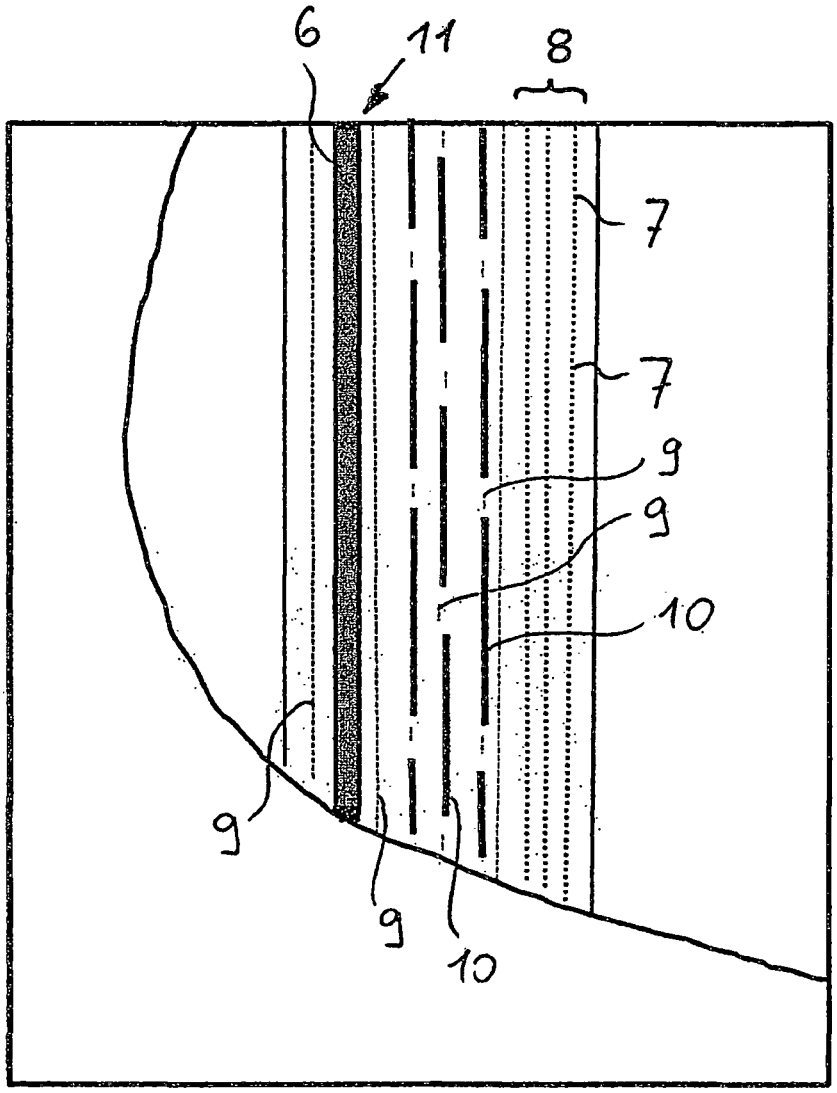
FIG. 6 the object of FIG. 4 in a partially broken-away front view.

The strip 4 is arranged across the entire height of the packaging container 1 between transverse seams 5.1 and 5.2. In contrast to the embodiment according to FIG. 1, a needled area 8 which is provided with venting openings 7 is formed across the entire length of the strip 4. The strip 4 forms the inner ply 4 and is connected by longitudinal seams 13 with the front wall 2 (compare FIGS. 5 and 6). Viewed in longitudinal direction, a no-seal strip 6 is arranged in the left half of the intermediate space and is thus arranged, in a projection onto the plane of the front wall 2, spaced apart from the area 8. Air can be guided across the needled area 8 along spacers formed in the present case as interrupted embossment lines 9 and along fixations 10 of the inner ply with the front wall 2 in the direction of the venting openings 11 present at the end of the no-seal strip 6. In this embodiment, no repeating pattern orientation is thus provided.

The embodiment according to FIG. 1 as well as the embodiment according to FIG. 4 are provided with a front wall 2 and a rear wall 3 which are produced from a flat film connected laterally by a longitudinal seam 12 at the rear of the packaging container 1. The longitudinal seam 12 closes the packaging container 1 in the circumferential direction and is arranged at the rear wall 3. The front wall 2 is thus free of a longitudinal seam 12 that closes the packaging container in circumferential direction.

Both packaging containers have in common that the strip that forms the inner ply 4 is arranged by the longitudinal seams 13 on the inner side of the front wall 2 across the entire height of the packaging container and thus an intermediate space 14 is formed.

Via this intermediate space 14, venting of the holding space 15 which is formed otherwise between front wall 2 and rear wall 3 is realized.

What is claimed is:

1. A flexible packaging container for bulk goods, the packing container comprising:

a front wall and a rear wall;

a holding space formed between the front wall and the rear wall for bulk goods;

the front wall and the rear wall at least partially formed of a film material;

an inner ply formed by a strip arranged on a side of the front wall facing the rear wall;

the inner ply having first and second longitudinal edges and being attached to the front wall by two longitudinal seams extending between top and bottom transverse seams of the packaging container along the first and second longitudinal edges of the inner ply, wherein the inner ply and the front wall define an intermediate space separated by the inner ply from the holding space, the inner ply not being attached to the front wall laterally outside of the two longitudinal seams;

at least one holding space venting opening arranged in a ply material of the inner ply between the two longitudinal seams and arranged at a spacing from the two longitudinal seams, wherein the at least one holding space venting opening is configured to vent the holding space into the intermediate space;

each of the top and bottom transverse seams sealing the front and rear walls together, in which at least a portion of each of the top or bottom transverse seams including an inner ply section where the inner ply is sealed between the front and rear walls;

at least one container venting opening interrupting the top transverse seam or the bottom transverse seam in the inner ply section between the inner ply and the front wall, such that no interruption is present in the top or bottom transverse seams other than at the inner ply section, wherein the at least one container venting opening is permanently unsealed to always vent the intermediate space to ambient atmosphere;

wherein the rear wall has a longitudinal seam closing the packaging container in a circumferential direction;

wherein the front wall has no longitudinal seam closing the packaging container in the circumferential direction and is thereby adapted to include printed-on information and/or advertising that is uninterrupted by a longitudinal seam.

2. The packaging container according to claim 1, wherein the inner ply is a film part that is separated from said film material.

3. The packaging container according to claim 1, wherein the ply material of the inner ply is different from said film material.

4. The packaging container according to claim 3, wherein the ply material of the inner ply is thinner than said film material.

5. The packaging container according to claim 1, wherein the inner ply extends across an entire height of the packaging container and is fixed by the bottom and top transverse seams.

6. The packaging container according to claim 1, further comprising a no-seal strip arranged in the top transverse seam or the bottom transverse seam to form the at least one container venting opening.

7. The packaging container according to claim 1, further comprising a no-seal strip extending from the bottom transverse seam to the top transverse seam to form the at least one container venting opening in the bottom transverse seam and in the top transverse seam.

8. The packaging container according to claim 1, wherein the at least one container venting opening is an unsealed or non-adhesive area of the top transverse seam or of the bottom transverse seam and is continuously open without requiring overpressure.

9. The packaging container according to claim 1, wherein, viewed in a longitudinal direction of the inner ply, the at least one container venting opening and the at least one holding space venting opening are spaced apart from each other.

10. The packaging container according to claim 1, wherein, viewed in a direction transverse to a longitudinal direction of the inner ply, the at least one container venting opening and the at least one holding space venting opening are spaced apart from each other.

11. The packaging container according to claim 1, further comprising at least one spacer spacing apart the inner ply and the front wall.

12. The packaging container according to claim 11, wherein the at least one spacer is formed of the ply material, which is a film material, of the inner ply.

13. The packaging container according to claim 1, further comprising at least one deflecting element preventing a direct connection between the at least one holding space venting opening and the at least one container venting opening.

14. The packaging container according to claim 1, wherein the inner ply is fastened by at least one fixation between the two longitudinal seams and the front wall.

15. A flexible packaging container for bulk goods, the packing container comprising:

a front wall and a rear wall;

a holding space formed between the front wall and the rear wall for bulk goods;

the front wall and the rear wall at least partially formed of a film material;

an inner ply formed by a strip arranged on a side of the front wall facing the rear wall;

the inner ply having first and second longitudinal edges and being attached to the front wall by two longitudinal seams extending between top and bottom transverse seams of the packaging container along the first and second longitudinal edges of the inner ply, wherein the inner ply and the front wall define an intermediate space separated by the inner ply from the holding space, the inner ply having a width extending between the first and second longitudinal edges that is smaller than a width of the front wall;

at least one holding space venting opening arranged in a ply material of the inner ply between the two longitudinal seams and arranged at a spacing from the two longitudinal seams, wherein the at least one holding space venting opening is configured to vent the holding space into the intermediate space;

each of the top and bottom transverse seams sealing the front and rear walls together, in which at least a portion of each of the top or bottom transverse seams including an inner ply section where the inner ply is sealed between the front and rear walls;

at least one container venting opening interrupting the top transverse seam or the bottom transverse seam in the inner ply section between the inner ply and the front wall, such that no interruption is present in the top or bottom transverse seams other than at the inner ply section, wherein the at least one container venting opening is permanently unsealed to always vent the intermediate space to ambient atmosphere;

wherein the rear wall has a longitudinal seam closing the packaging container in a circumferential direction;

wherein the front wall has no longitudinal seam closing the packaging container in the circumferential direction and is thereby adapted to include printed-on information and/or advertising that is uninterrupted by a longitudinal seam.

* * * * *